US010600603B2

(12) United States Patent
Jaenicke

(10) Patent No.: US 10,600,603 B2
(45) Date of Patent: Mar. 24, 2020

(54) SWITCHING DEVICE AND SWITCH-OFF METHOD FOR OPERATING A SWITCHING DEVICE

(71) Applicant: SIEMENS AKTIENGESELLSCHAFT, Munich (DE)

(72) Inventor: Lutz-Ruediger Jaenicke, Mahlow (DE)

(73) Assignee: Siemens Aktiengesellschaft, Munich (DE)

( * ) Notice: Subject to any disclaimer, the term of this patent is extended or adjusted under 35 U.S.C. 154(b) by 204 days.

(21) Appl. No.: 15/039,202

(22) PCT Filed: Nov. 19, 2014

(86) PCT No.: PCT/EP2014/075028

§ 371 (c)(1),
(2) Date: May 25, 2016

(87) PCT Pub. No.: WO2015/078750

PCT Pub. Date: Jun. 4, 2015

(65) Prior Publication Data

US 2017/0018390 A1 Jan. 19, 2017

(30) Foreign Application Priority Data

Nov. 29, 2013 (DE) ..... 10 2013 224 621

(51) Int. Cl.

| | |
|---|---|
| ***H01H 89/00*** | (2006.01) |
| ***H01H 33/59*** | (2006.01) |
| ***H01H 9/54*** | (2006.01) |
| ***H01H 33/66*** | (2006.01) |

(52) U.S. Cl.
CPC ..... *H01H 89/00* (2013.01); *H01H 9/54* (2013.01); *H01H 9/548* (2013.01); *H01H 33/596* (2013.01); *H01H 33/66* (2013.01)

(58) Field of Classification Search
CPC ..... H01H 89/00; H01H 9/54; H01H 9/548; H01H 33/596; H01H 33/66
USPC ..... 307/115
See application file for complete search history.

(56) References Cited

U.S. PATENT DOCUMENTS

| | | | | |
|---|---|---|---|---|
| 3,227,924 | A | 1/1966 | Wutz | |
| 4,159,498 | A * | 6/1979 | Noeske | H01H 33/66 218/140 |
| 5,561,579 | A * | 10/1996 | Gyugyi | H02H 7/30 361/100 |
| 5,650,901 | A | 7/1997 | Yamamoto | |
| 8,717,716 | B2 | 5/2014 | Haefner et al. | |
| 9,240,680 | B2 | 1/2016 | Hartmann et al. | |

(Continued)

FOREIGN PATENT DOCUMENTS

| | | | |
|---|---|---|---|
| CN | 103370760 | A | 10/2013 |
| DE | 1236052 | B | 3/1967 |
| DE | 19601540 | A1 | 11/1996 |

(Continued)

*Primary Examiner* — Alfonso Perez Borroto
(74) *Attorney, Agent, or Firm* — Laurence Greenberg; Werner Stemer; Ralph Locher

(57) ABSTRACT

A switching device includes a first conventional switching point and a second conventional switching point which are electrically connected in series by a non-conventional switching point. A switch-off method for operating a switching device is also provided.

13 Claims, 2 Drawing Sheets

(56) References Cited

U.S. PATENT DOCUMENTS

| | | | | |
|---|---|---|---|---|
| 2013/0278078 | A1* | 10/2013 | Ohlsson | H01H 9/548<br>307/113 |
| 2017/0004948 | A1* | 1/2017 | Leyh | H01H 89/00 |

FOREIGN PATENT DOCUMENTS

| | | | |
|---|---|---|---|
| DE | 10002870 | A1 | 8/2001 |
| DE | 102011005905 | A1 | 9/2012 |
| EP | 2469552 | A2 | 6/2012 |
| JP | 2003123569 | A | 4/2003 |
| JP | 2005019107 | A | 1/2005 |

* cited by examiner

SWITCHING DEVICE AND SWITCH-OFF METHOD FOR OPERATING A SWITCHING DEVICE

BACKGROUND OF THE INVENTION

Field of the Invention

The invention relates to a switching device comprising a first conventional switching point, a second conventional switching point and a non-conventional switching point.

A switching device of this sort is known, for example, from patent application DE 10 2011 005 905 A1. A switching device is described there which comprises a gas-insulated power switch and a vacuum power switch as conventional switching points. A device for generating an opposing current, comprising a thyristor, is connected electrically in parallel with the vacuum power switch. The structure of the device for generating an opposing current is that of a non-conventional switching point.

The known switching device is in particular suitable for switching direct currents. In order to switch a direct current off, an opposing current is impressed onto the direct current that is to be interrupted by means of the device for generating an opposing current, in order to interrupt it.

Expensive components such as thyristors, IGBTs or power transistors must be used for the non-conventional switching point when the known switching device is used, in particular in the high and very high voltage ranges, i.e. at voltages of several thousand volts and at currents to be interrupted of several kiloamperes. The design of these non-conventional switching points is such that they must be dimensioned both in terms of their voltage loading capacity as well as of their current loading capacity, appropriately for the current that is to be interrupted and for the driving electrical voltage. This necessitates expensive non-conventional switching points, so that a not inconsiderable portion of the costs of the switching device is determined by the non-conventional switching point.

BRIEF SUMMARY OF THE INVENTION

It is accordingly the object of the invention to provide a switching device of the type mentioned above that promises a reduction in costs with high operational reliability.

According to this object, the invention is achieved by a switching device of the type mentioned above in that the first conventional switching point, the second conventional switching point and the non-conventional switching point together constitute a series circuit.

Conventional switching points are switching points which, in order to establish an electrically conductive current path, bring switching contact pieces that are movable with respect to one another into electrical contact and which, conversely, during an interruption of a current path, remove switching contact pieces that are movable with respect to one another away from each other in order to allow an electrically insulating medium to enter between the switching contact pieces. In contrast to this, non-conventional switching points refers to a construction in which the impedance properties of the switching point are varied independently of a mechanical movement. Independently of the switching state of the switching point, a physical connection remains between the potentials that are to be isolated. Only the impedance of the switching point is made to change. The switching point can, for example, be formed of a semiconductor which, when required, can be placed into an electrically conductive state or into an electrically insulating state. Since, when semiconducting components are used, a through-connection or interruption of a current path is effected by a semiconductor itself, these are also referred to as power semiconductors. Non-conventional switching points are, for example, power electronics units. A power electronics unit can, in addition to the actual switching point, also comprise further components which are used to control the impedance of the switching point. As non-conventional switching points, thyristors, GTOs, IGCTs, IGBTs or general power transistors etc. can, for example, be used. In some cases, the non-conventional switching point can also include a plurality of semiconductor elements and, where appropriate, it can have a modular structure.

In a series circuit, a group of switching points constitutes an electrically conductive path that extends from a point A to a point B, wherein the switching points are each connected electrically one after another. The series circuit of switching points is part of a switching segment of the electrical switching device. This provides the possibility that a voltage to be maintained between the points A and B which must be handled during a switch-off process is distributed over a plurality of switching points. In an ideal case a voltage distribution develops over the switching points such that approximately the same voltage drop occurs across each of the switching points, and thus each of the switching points only needs to be dimensioned for a fraction of the total voltage to be handled. For this purpose the switching device can comprise appropriate control means such as, for example, control resistors, in order to achieve the most uniform possible voltage distribution. When a first and a second switching point, both conventional, and a non-conventional switching point are used, it can for example occur that approximately one third of the electrical voltage to be handled by the switching segment of the switching device is dropped across each of the switching points. If necessary it can, however, also be provided that a different voltage distribution, depending on the dimensioning of the individual switching points, is intended, so that, for example, one of the switching points is loaded to a higher degree, whereby another switching point is relieved. In order to reduce the loading of the switching points it is, for example, furthermore possible to increase the number of the conventional switching points, but it is also possible to increase the number of the non-conventional switching points.

A further advantageous implementation can provide that the non-conventional switching point is located in the series circuit between the first conventional switching point and the second conventional switching point.

An arrangement of the non-conventional switching point between a first and a second conventional switching point permits or supports an even distribution of the total voltage over the individual switching points. During switch-off processes in particular, the non-conventional switching point can be protected from overloads by conventional switching points located in front of and behind it. It is thus, for example, possible that an ignition of a switch-off arc is desired in the conventional switching points in the course of an interruption of a current, whereby, due to the arc voltage that develops and the increasing total impedance in the series circuit of the switching device, a loading at the non-conventional switching point is reduced. An ignition of a switch-off arc is thus advantageous at least in one, in particular in the majority or in all, of the conventional switching points, in order to increase the impedance of the switching segment of the switching device during a switch-off process, and to support an interruption of the electrical current flowing through the switch-off arc or arcs. Through this it is possible to reduce the dimensions of the non-conventional switching point, so that this only needs to interrupt a direct current that has already been reduced by the arcs. An economical non-conventional switching point accordingly results, whereby the total cost situation for the switching device is improved.

A further advantageous embodiment can provide that a plurality of conventional switching points are connected in series, and the non-conventional switching point divides the plurality of conventional switching points into approximately equal groups of conventional switching points.

A plurality of conventional switching points comprises at least a first and a second non-conventional switching point. Through an arrangement of the non-conventional switching point between the two conventional switching points, a division of the conventional switching points is made into a first and a second group. A grouping of the conventional switching points of this type supports the effectiveness of the non-conventional switching point. In particular, if the number of conventional switching points is increased to more than two switching points, the total voltage can be appropriately distributed over the switching points of the switching device, and the voltage stress on the individual switching point reduced. The non-conventional switching point is protected from a voltage overload by a voltage distribution over a plurality of conventional switching points. Advantageously, the groups should exhibit similar impedances, so that a symmetrical voltage distribution results between the groups. If the number of conventional switching points is increased, for example, to ten or more conventional switching points, the voltage stress on each of the individual switching points is reduced, whereby the voltage distribution over the non-conventional switching point is also reduced. A division into corresponding groups helps to compensate for asymmetries in the voltage distribution, and so to avoid an overload of the individual switching points. In total, an equal voltage stress on each of the groups should advantageously be present when switching off. A symmetrical voltage distribution of this sort can additionally be supported by a control of the voltage distribution, for example by control resistors.

The number of the conventional switching points should preferably be an even number, in which the same number of conventional switching points are arranged in each of the groups. It can, however, also be provided that, depending on the implementation of the conventional switching points, different numbers of conventional switching points are contained in the groups, so that for example the voltage distribution over the switching points can be controlled in an improved manner, in particular that an even distribution of the voltage stress is achieved over all switching points.

A further advantageous embodiment can provide that at least one of the conventional switching points comprises a vacuum switching chamber.

A vacuum switching chamber encloses an evacuated space in which, for example, switching contact pieces that are movable with respect to one another are arranged. The individual switching contact pieces are drawn away from each other during a switch-off process, while a switch-off arc can be ignited between the switching contact pieces inside the evacuated space. Advantageously, the conventional switching points should have the same type of construction, so that an even distribution of the voltages to be handled can develop over the individual switching points.

It can, for example, be provided that at a rated voltage of 350 000 V, two groups each of ten conventional switching points are used, in which a first group of ten conventional switching points is connected in series in front of a non-conventional switching point, and a second group of ten conventional switching points is connected in series behind a non-conventional switching point. With an ideal voltage distribution, a rated voltage of, for example, 17 500 V would result at each switching point. Under real conditions, a voltage imbalance must be assumed, so that the conventional switching points should be designed for a rated voltage of at least 20 000 V, for example. Comparatively short contact strokes are required in the evacuated space of a vacuum switching chamber for these 20 000 V, so that, in combination with comparatively fast drives, a fast switching of an electrical current by the switching device can also be achieved. Here, the non-conventional switching point is also designed for 20 000 V due to the series circuit and arrangement between the two groups of conventional switching points. As can be seen from this example, the series circuit of several conventional switching points, in particular in front of and behind a non-conventional switching point, creates the possibility of using power semiconductors with reduced rated voltages.

A further object of the invention is to provide a switch-off method for the operation of a switching device, wherein the switching device comprises a first conventional switching point and a second conventional switching point as well as a non-conventional switching point, wherein the two conventional switching points and the non-conventional switching point are connected in a series circuit. According to the object, this is achieved with a switch-off method of the type mentioned above, in that the conventional switching points are switched off first, after which the non-conventional switching point is switched off.

The switch-off method is in particular suitable for interrupting direct currents that are driven by a DC voltage. Before the switch-off method starts, all of the conventional and non-conventional switching points are in a connected-through state, i.e. the switching device that is to be switched off is in the switched-on state, and comprises a current path of low impedance. In order to initiate switching off, an interruption of the conventional switching points is first made, wherein the non-conventional switching point is maintained in its ON state. Consequently, in particular at an interruption of a direct current, a switch-off arc is ignited between the respective switching contact pieces at least in one, but preferably in all, of the conventional switching points as a consequence of a separation of the contacts. Preferably this can occur in each case within an evacuated space. A finite time is required for the movement of the switching contact pieces, that are movable with respect to one another, of the conventional switching points. Already in the course of a switch-off process, i.e. before reaching the final positions of the switching contact pieces, that are movable with respect to one another, of the conventional switching points, the dielectric strength of the individual switching points, in particular in total, can already be sufficient to achieve an adequate dielectric strength (of the switching segment) at the switching device against, for example, what is known as a returning voltage. A returning voltage is a voltage which, as a result of grid impedances, oscillation processes or similar processes, develops during a switch-off process over the switching segment of the switching device and, in some cases, can reach a greater magnitude than the rated voltage of the switching device. In the time following the switching off of the conventional switching points, a switching-off impulse for the non-conventional switching points occurs. The non-conventional switching point is blocked, so that the non-conventional switching point interrupts the current that is to be interrupted, and thus extinguishes the switch-off arcs burning in the individual conventional switching points. With the blocking of the non-conventional switching point, the returning voltage across the non-conventional switching point rises as a consequence of the interrupted electrical current. In order to prevent the electrical current from reigniting, the non-conventional switching point performs the voltage maintenance at the switching device until the non-conventional switching points exhibit an adequate dielectric strength after the switch-off arcs have extinguished, in order to ensure a potential isolation at the switching device.

After the switch-off arcs have extinguished, the dielectric strength of the conventional switching points rises. The non-conventional switching point thus only needs to handle the potential isolation at the electrical switching device during an initial interval of the rise of the returning voltage. After a short recombination time of the conventional switching points that are already open, and after the arcs there which have just extinguished, the returning voltage is distributed over the series circuit of conventional switching points and non-conventional switching point. It is advantageous to this switch-off method that the non-conventional switching point only has to handle the returning voltage alone during the recombination time of the conventional switching segment. During this time, the returning voltage increases. The voltage stress that develops here should be significantly smaller than the respective rated voltage of the non-conventional switching point. Building on the above-mentioned exemplary embodiment, it can be assumed that the rated voltage of the non-conventional switching point of 20 000 V will not be exceeded, since, when the returning voltage reaches the magnitude of the rated voltage of the non-conventional switching point, the conventional switching points have already taken over the voltage maintenance.

A further advantageous embodiment can provide that an arc is ignited in at least one of the conventional switching points when the conventional switching points are switched off.

If an arc is drawn in a conventional switching point, the impedance of the whole switching segment of the switching device is already increased. What is known as an arc voltage develops across the conventional switching point. As a result, switching off the current flowing (through the arc) is supported by the non-conventional switching point.

A further advantageous embodiment can provide that a potential isolation is maintained by the non-conventional switching point until the conventional switching points have settled.

As a result of the burning arc and the associated contamination, the conventional switching points require a finite time for an insulating segment between the switching contact pieces to become properly established. As a result, the dielectric strength between the switching contact pieces of the conventional switching points is improved within this period of time. The settling of the conventional switching points can here take place for example within fractions of a second. During these fractions of a second, the non-conventional switching point is provided to handle the dielectric strength of the switching device, in particular during a rise in a returning voltage, and to prevent reignition of an arc or a renewed flow of an electrical current.

A further advantageous embodiment can provide that an arc burning in a conventional switching point is extinguished by the non-conventional switching point.

During a switching process, in particular a switch-off process, the switching segment of the switching device is already prepared for a final interruption of the current at the switching device by the burning of an arc in a conventional switching point. The impedance of the switching segment of the switching device is already increased by the burning arc, its impedance not yet being so great that a complete interruption of an electrical current results. A complete interruption of the electrical current is effected by blocking the non-conventional switching segment, so that an arc burning in the conventional switching point is also extinguished.

It can advantageously also be provided that the conventional switching points receive a switch-off impulse almost simultaneously.

An almost simultaneous triggering of the conventional switching points results in an approximately synchronous movement of the switching contact pieces that are movable with respect to one another. Accordingly, an arc is ignited advantageously almost simultaneously in all the conventional switching points, whereby an approximately simultaneous increase in the impedance of the switching segment of the switching device is achieved. Each arc is driven by a corresponding arc voltage, wherein the impedance of the burning arc can be estimated as being greater than the impedance of the conventional switching points in the switched-on state.

BRIEF DESCRIPTION OF THE SEVERAL VIEWS OF THE DRAWING

An exemplary embodiment of the invention is shown schematically in a drawing below, and described in more detail in what follows. Here.

DESCRIPTION OF THE INVENTION

Figure 1:
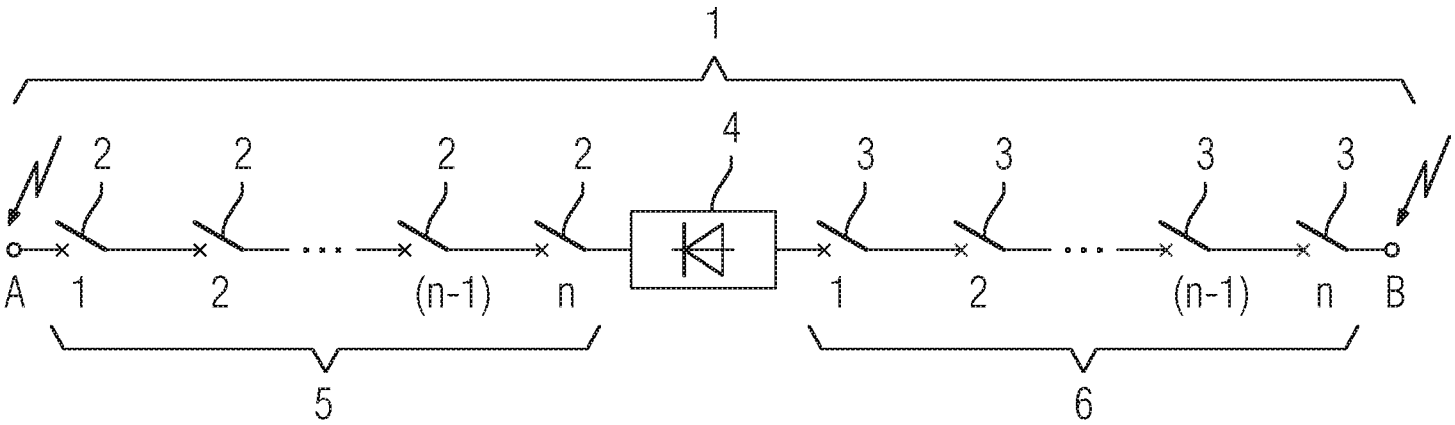
FIG. 1: shows a circuit comprising a plurality of conventional switching points and a non-conventional switching point.

The circuit diagram of FIG. 1 shows a switching device 1 that acts to interrupt a current path between a point A and a point B. The electrical switching device 1 is preferably designed for switching a direct current that is driven by a DC voltage. The electrical switching device 1 comprises a first conventional switching point 2 as well as a second conventional switching point 3. The switching device 1 further comprises a non-conventional switching point 4. The non-conventional switching point 4 is arranged electrically in series between the first conventional switching point 2 and the second conventional switching point 3. In the present example, n first conventional switching points 2 and n second conventional switching points 3 are provided. Ten first conventional switching points 2 and ten second conventional switching points 3 can be provided, for example. The first conventional switching points 2 are all connected electrically in series, the first conventional switching points 2 that lie on one side of the non-conventional switching point 4 constituting a first group 5 of conventional switching points 2. The second conventional switching points 3 constitute a second group 6 of conventional switching points 3.

The respective first or second conventional switching points 2, 3 are connected in series within each of the two groups 5, 6. Since the first and second groups 5, 6 of conventional switching points 2, 3 are connected in series with the non-conventional switching point 4, a series circuit of conventional switching points 2, 3 together with a non-conventional switching point 4 connected between them results. The non-conventional switching point 4 in this case can, for its part, also have a modular structure, and comprise, for example, a power semiconductor. The non-conventional switching point 4 can, for example, comprise thyristors, IGBTs, power transistors and so forth based on semiconductors.

Figure 2:
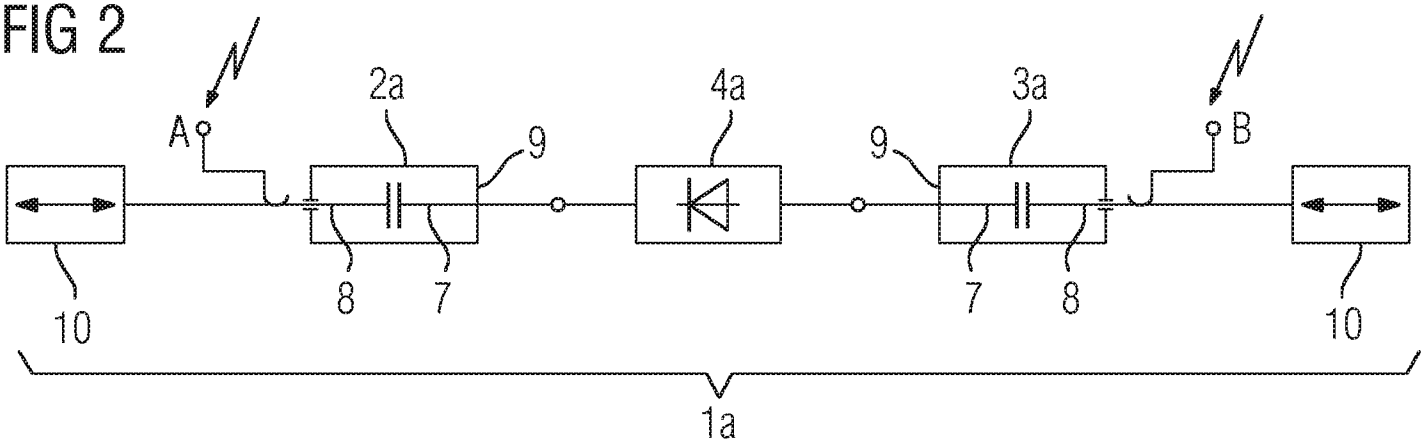
FIG. 2: shows an apparatus with a first conventional switching point, a second conventional switching point and a non-conventional switching point.

FIG. 2 shows a switching device 1*a* that comprises a non-conventional switching point 4*a*, a first conventional switching point 2*a* and a second conventional switching point 3*a*. In the present case, the two conventional switching points 2*a*, 3*a* are formed as vacuum switching tubes, each comprising a locally fixed switching contact piece 7 and a movable switching contact piece 8 that is mounted such that it can move relative to the locally fixed switching contact piece 7. The vacuum switching tubes each comprise a tube body 9 that is impermeable to fluids and whose interior is evacuated. The respective movable switching contact piece 8 protrudes through the respective tube body 9 impermeably to fluids, and can move relative to the tube body 9 and to the respective locally fixed switching contact piece 7. A drive device 10 which can couple a movement to the movable contact piece 8 is connected to each respective movable switching contact piece 8. The two locally fixed contact pieces 7 of the two conventional switching points 2*a*, 3*a* are for their part each connected to one connection of the non-conventional switching point 4*a*. A tap from contacting points A, B of the switching device 1*a* is provided at the movable contact pieces 8 through a sliding contact arrangement. In the exemplary embodiment of FIG. 2, the use of precisely one first conventional switching point 2*a* and precisely one second conventional switching point 3*a* is provided. The arrangement of a non-conventional switching point 4*a* is provided between the two conventional switching points 2*a*, 3*a*. Further first or further second conventional switching points 2*a*, 3*a* can furthermore also be provided; these may have the same construction, but may however also have different constructions.

Figure 3:
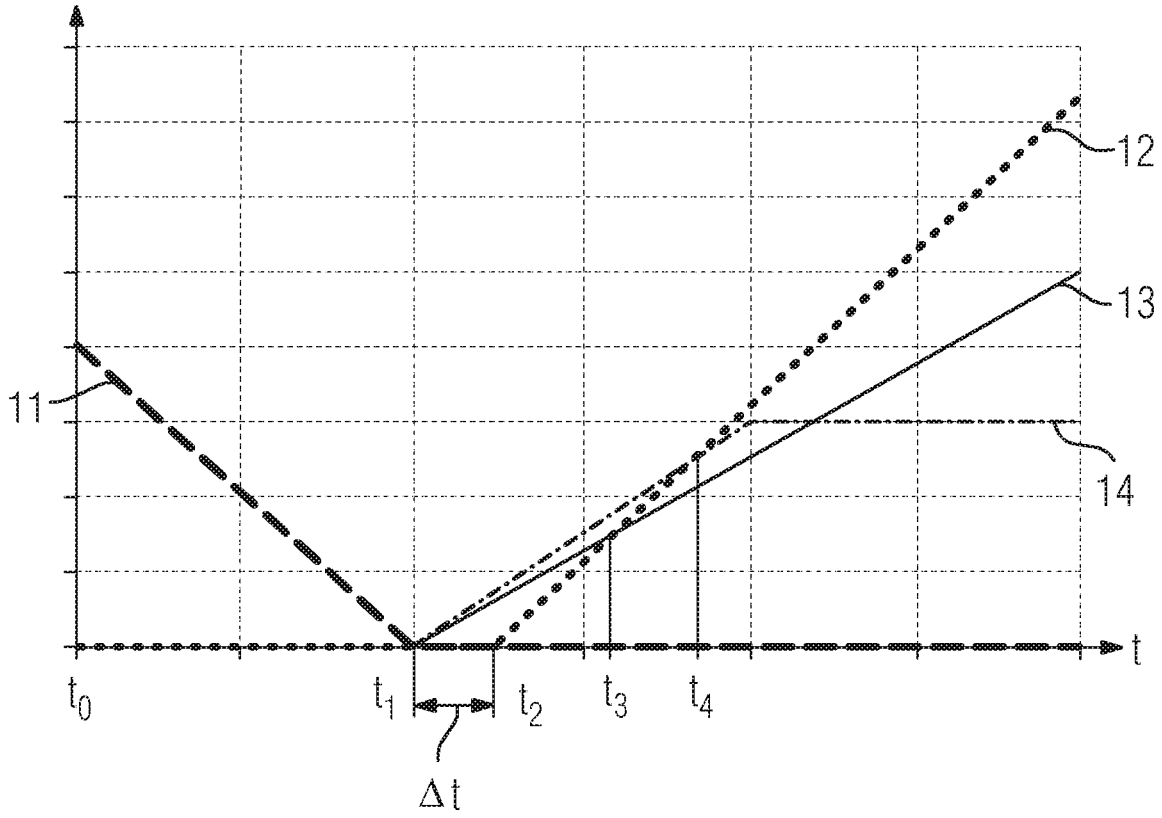
FIG. 3: shows a diagram.

FIG. 3 shows a diagram in which a graph 11 shows the curve of a direct current to be switched off against time. A graph 12 symbolizes the dielectric strength of the conventional switching points 2*a*, 3*a*. A graph 13 shows schematically the curve of the returning voltage after interruption of the direct current. A graph 14 shows the curve of the dielectric strength of the non-conventional switching point 4*a*.

A switch-off signal has already been sent to the conventional switching points 2*a*, 3*a* at time $t_0$. The conventional switching points 2*a*, 3*a* are already open. The direct current that is to be interrupted at first continues to flow. Since the direct current is located in the series circuit of the switching device 1*a*, arcs are ignited in the conventional switching points 2*a*, 3*a*. The non-conventional switching point 4*a* is at this stage still in its switched-on state, i.e. the non-conventional switching point 4*a* exhibits a low impedance behavior. Due to the burning of the arcs in the conventional switching points 2*a*, 3*a*, the impedance of the switching device 1*a* initially increases in comparison with its switched-on state. After the conventional switching points 2*a*, 3*a* have opened, the non-conventional switching point 4*a* is also blocked, and the impedance of the non-conventional switching point rises. The direct current (graph 11) that is to be interrupted is pushed down towards zero, and is interrupted by the non-conventional switching point 4*a* (time $t_1$). With the interruption of the direct current, all the arcs in all of the conventional switching points 2*a*, 3*a* are also extinguished. The direct current is interrupted at time $t_1$. After this, it has a magnitude of zero amperes (graph 11). With the interruption of the direct electrical current at the time $t_1$, the arcs in the conventional switching points 2*a*, 3*a* are also extinguished. As a result of the thermal effect of the arcs in the conventional switching points 2*a*, 3*a*, the insulating segments are contaminated, and do not yet reach their full insulation strength. The dielectric strength (graph 12) of the conventional switching point 2*a*, 3*a* is not yet present. The conventional switching points 2*a*, 3*a* settle during the time interval $\Delta t$ between the times $t_1$ and $t_2$. When the settling is complete, the dielectric strength of the conventional switching points 2*a*, 3*a* rises (graph 12).

With the interruption of the direct current, the non-conventional switching point 4*a* immediately takes over the voltage maintenance at the electrical switching device 1*a*. The returning voltage (graph 13) that develops with the interruption of the direct current ($t_1$) rises.

At the end of the time interval $\Delta t$ the dielectric strength (graph 12) of the conventional switching points 2*a*, 3*a* increases faster than the returning voltage (graph 13) rises.

A state in which the dielectric strength of the conventional switching points 2*a*, 3*a* is greater than the magnitude of the returning voltage thus arises at time $t_3$. From this time onwards the conventional switching points 2*a*, 3*a* would be able to perform the voltage maintenance at the switching device 1*a*.

At time $t_4$ the dielectric strength of the conventional switching points 2*a*, 3*a* also exceeds the dielectric strength of the non-conventional switching point 4*a*. The dielectric strength of the non-conventional switching point 4*a* now no longer needs to rise, i.e. the non-conventional switching point 4*a* can be designed such that with a further increasing dielectric strength of the conventional switching points 2*a*, 3*a* the dielectric strength of the non-conventional switching point 4*a* no longer has to rise. Accordingly, it is possible to employ economical non-conventional switching points 4*a*. Through an overlap in the time interval between $t_3$ and $t_4$ and a further increasing dielectric strength of the non-conventional switching point 4*a*, additional security is created in order to achieve sufficient dielectric strength of the switching device 1*a* during a switch-off process.

The electrical switching device 1*a* is subjected to a returning voltage (graph 13) after an interruption of the direct electrical current. A returning voltage develops across the electrical switching device 1*a* with the interruption of the direct current. This returning voltage (graph 13) is, however, not exclusively determined by the originally driving voltage, but transient processes can also occur during a switch-off process, which further increase the returning voltage 13. Transient processes can also result, which can cause the returning voltage to rise, for example in the manner of an exponential function.

The invention claimed is:

1. A switching device, comprising:

a first conventional switching point, a second conventional switching point and a non-conventional switching point together forming a series circuit;

said series circuit configured to intentionally ignite an arc in at least one of the conventional switching points when the conventional switching points are switched off; and said non-conventional switching point being a thyristor.

2. The switching device according to claim 1, wherein said non-conventional switching point is located in said series circuit between said first conventional switching point and said second conventional switching point.

3. The switching device according to claim 1, wherein:

said first conventional switching point and said second conventional switching point are part of a plurality of conventional switching points connected in series; and said non-conventional switching point divides said plurality of conventional switching points into approximately equal groups of conventional switching points.

4. The switching device according to claim 1, wherein at least one of said conventional switching points includes a vacuum switching chamber.

5. A switch-off method for operating a switching device, the method comprising the following steps:

providing the switching device with a first conventional switching point, a second conventional switching point and a non-conventional switching point connected together in a series circuit;

initially switching-off the conventional switching points;

intentionally igniting an arc in at least one of the conventional switching points when the conventional switching points are switched off; and subsequently switching-off the non-conventional switching point.

6. The switch-off method according to claim 5, which further comprises maintaining a potential isolation by the non-conventional switching point until the conventional switching points have settled.

7. The switch-off method according to claim 5, which further comprises extinguishing an arc burning in a conventional switching point by the non-conventional switching point.

8. The switch-off method according to claim 5, wherein the conventional switching points receive a switch-off impulse simultaneously.

9. The switch-off method according to claim 5, which further comprises providing the non-conventional switching point as a thyristor.

10. The switch-off method according to claim 5, wherein the step of intentionally igniting an arc in at least one of the conventional switching points when the conventional switching points are switched off includes intentionally igniting an arc simultaneously in the first conventional switching point and the second conventional switching point when the conventional switching points are switched off.

11. A switching device, comprising:

a first conventional switching point, a second conventional switching point and a single thyristor connected between said first conventional switching point and said second conventional switching point, together forming a series circuit;

said series circuit configured to intentionally ignite an arc in at least one of the conventional switching points when the conventional switching points are switched off.

12. The switching device of claim 11, wherein said series circuit is configured to intentionally ignite an arc in both said first conventional switching point and said second conventional switching point before switching off said single thyristor.

13. A switch-off method for operating a switching device, the method comprising the steps of:

providing a switching device according to claim 1;

initially switching-off the conventional switching points;

intentionally igniting an arc in at least one of the conventional switching points when the conventional switching points are switched off; and subsequently switching-off the single thyristor.

* * * * *